US008852395B2

(12) United States Patent
Trolin et al.

(10) Patent No.: US 8,852,395 B2
(45) Date of Patent: Oct. 7, 2014

(54) METHOD AND ARRANGEMENT FOR ADDING TREATMENT LIQUORS TO CELLULOSE MATERIAL IN A DOWN FLOW VESSEL

(75) Inventors: Daniel Trolin, Camacari (BR); Fredrik Wilgotson, Sundsvall (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/006,969

(22) PCT Filed: Mar. 25, 2011

(86) PCT No.: PCT/SE2011/050339

§ 371 (c)(1),
(2), (4) Date: Nov. 27, 2013

(87) PCT Pub. No.: WO2012/134358

PCT Pub. Date: Oct. 4, 2012

(65) Prior Publication Data

US 2014/0069598 A1 Mar. 13, 2014

(51) Int. Cl.

| | |
|---|---|
| ***D21C 7/14*** | (2006.01) |
| ***D21C 7/06*** | (2006.01) |
| ***D21C 3/24*** | (2006.01) |

(52) U.S. Cl.

CPC .. *D21C 3/24* (2013.01); *D21C 7/06* (2013.01); *D21C 7/14* (2013.01)

USPC ..... 162/41; 162/233; 162/237; 162/247

(58) Field of Classification Search

CPC ..... D21C 7/14; D21C 7/06
USPC ..... 162/41, 233, 237
See application file for complete search history.

(56) References Cited

U.S. PATENT DOCUMENTS

2006/0191651 A1* 8/2006 Bjorkstrom et al. ..... 162/52

FOREIGN PATENT DOCUMENTS

| | | |
|---|---|---|
| SE | WO03106765 | 12/2003 |
| SE | WO2005116327 | 12/2005 |
| SE | WO2011021968 | 2/2011 |

* cited by examiner

*Primary Examiner* — Anthony Calandra
(74) *Attorney, Agent, or Firm* — Rolf Fasth; Fasth Law Offices

(57) ABSTRACT

The method and arrangement are for adding treatment liquid to comminuted cellulose material, preferably wood chips, during the manufacture of chemical pulp in a continuous process. The process is using a down-flow vessel wherein chips are descending down the vessel in a plug flow and wherein treated chips are continuously fed out at the bottom of the vessel. By arranging at least one telescopic pipe inside the vessel that extends down into the plug flow makes it possible to adjust the position for the addition of treatment liquid depending on current operational parameters.

8 Claims, 5 Drawing Sheets

METHOD AND ARRANGEMENT FOR ADDING TREATMENT LIQUORS TO CELLULOSE MATERIAL IN A DOWN FLOW VESSEL

PRIOR APPLICATION

This application is a U.S. national phase application that is based on and claims priority from International Application No. PCT/SE2011/050339, filed 25 Mar. 2011.

TECHNICAL FIELD

The present invention concerns a method and an arrangement for adding treatment liquors to comminuted cellulose material, preferably wood chips, during the manufacture of chemical pulp in a continuous process using a down flow vessel where chips are descending down the vessel in a plug flow.

BACKGROUND AND SUMMARY OF THE INVENTION

In old conventional Prior Art for cooking of chemical cellulose pulp with continuous digesters it was common to use a pre-treatment arrangement with a chip bin, steaming vessel and an impregnating chip chute, before the cooking process is established in the digester. Steaming has been carried out in one or several steps in the chip bin, prior to the subsequent formation of a slurry of the chips in an impregnation fluid or a transport fluid. The steaming has been considered to be absolutely necessary in order to be certain of expelling the air, such that the impregnation fluid can fully penetrate the chips, and such that air is not drawn into the system.

Attempts have been made to integrate the chip bin with the impregnation vessel in order to obtain in this manner a simpler system.

Already in U.S. Pat. No. 2,803,540, a system was revealed in which the chips from a chip bin were fed to a vessel in which a combined steaming and impregnation was achieved. In this vessel, the chips were steamed at the upper part of the vessel and impregnation fluid at the same temperature was added at various levels in the vessel using distributing annular manifolds/headers located outside of the vessel wall, and having nozzles penetrating the wall. These principles were also applied in a process known as "Mumin cooking", which is described in "Continuous Pulping Processes", Technical Association of the Pulp and Paper Industry, 1970, Sven Rydholm, page 144. In this process, unsteamed chips were passed to a combined impregnation vessel, where steaming was obtained in the upper part, and to which impregnation fluid was added at a point in the upper part of the vessel during forced circulation. The impregnation fluid was in this case carried exclusively in the same direction of flow as the chips.

A similar system with a low pressure first common steaming and impregnation vessel is shown in U.S. Pat. No. 3,532,594, which also was put into operation for example at the Skoghall mill in Sweden. Here was heated impregnation liquid added via a central pipe to the chip volume, but also showing an additional central pipe for steam supply. This system was later abandoned due to various reasons such as run ability problems, capacity problems in subsequent feeding system and far too high reject and shive content in the blown pulp.

A system is shown in U.S. Pat. No. 5,635,025 in which the chips are fed without prior steaming to a vessel in the form of a combined chip bin, impregnation vessel and chip chute.

Steaming of the chips takes place here, the chips lying above the fluid level, and a simple addition of impregnation fluid takes place trough the vessel wall below the liquid level.

A further such system is revealed in U.S. Pat. No. 6,280,567, in which the chips are fed without prior steaming to an atmospheric impregnation vessel in which the chips are heated by the addition of warm black liquor that maintains a temperature around 130-140 C. The added impregnation liquid is added via nozzles in a manner similar to what is shown in U.S. Pat. No. 2,803,540, i.e. using supply nozzles penetrating the wall of the vessel.

An alternative system is revealed by SE 523,850 in which pressurized black liquor is added to the upper part of the steaming vessel, whereby the black liquor after being subjected to a pressure reduction releases steam for the steaming process. The addition of the hot black liquor is made by a stationary horizontal supply pipe penetrating the chip bed, and having a multitude of holes over the length of the pipe. Even if the distribution of hot black liquor is made over a larger (but not over the complete cross-sectional) area this solution is not advisable since the horizontal pipe may hinder the chip plug movement. The prior art has mostly used either a stationary central pipe or stationary annular distribution nozzles located in the wall of the vessel for the added impregnation liquid to the combined steaming and impregnation vessel.

During the last few years the design capacity of new digester systems has been significantly increased, from typically 500-2000 ADt/24 h to production rates over 5000 ADt/24 h. As the design production rate increases the combined chip steaming and impregnation vessel diameter increases as well.

The technique with a common treatment vessel for steaming and impregnation at substantially atmospheric conditions is marketed by Metso Paper under the name of IMPBIN™. Several improvements of the concept have been patented in;

- SE 518.738 (=U.S. Pat. No. 7,381,302), with impregnation liquids added at successively increasing temperature at stationary positions in IMPBIN with higher static head;
- SE 528.448 (=EP1818445), with liquor circulations of IMPBIN separated from those in digester;
- SE 530.725 (=EP2065513), with cooling showers in top of IMPBIN for knocking down blow trough of malodorous gases.

Another disadvantage with known solutions is that this common steaming and impregnation vessel should optimize both functions, and it is a conflicting interest, as both steaming effect and impregnation time needs may vary depend on differing operating conditions and type of cellulose material fed to system. If there is a need to extend the impregnation time in the impregnation liquid it may not be possible to increase the liquid level, as such an increase may reduce the time in the steaming zone, or may reduce the amount of steam generated by flashing hot liquors. Flashing off steam beneath the liquid level creates a boiling effect that disrupts the formation of a well packed chip pile in the center of the vessel, which may cause a channeling effect inside the vessel hampering a uniform treatment of the cellulose material inside the vessel.

The above mentioned disadvantages with possibilities of extending the impregnation zone for wood material that is difficult to impregnate, or if other process conditions call for an increased liquid level in the impregnation zone, while still maintaining an efficient steaming effect, has become apparent after a large number of implementations of IMPBIN, especially those being fed with cellulose material of differing qualities during operation.

The principle object of the invention is to obtain an improved and more flexible arrangement for the addition of treatment liquids to chips during the manufacture of chemical pulp in a continuous process using a down flow vessel where chips are descending down the vessel in a plug flow, which arrangement does not demonstrate the disadvantages that are associated with other known solutions as described above.

A specific objective is to enable changes of the liquid level while adding steam, from a supply of steam and/or from flashing hot liquor, which addition of steam is controlled to take place very closely above the liquid level such that an optimum steaming effect is at hand independently of the established liquid level.

Another specific objective is to be able to change the retention time in the impregnation zone when changes in wood quality occur. These changes in wood quality could depend upon

- type of wood (hardwood/softwood/annual plants) or mixture thereof;
- changes from winter to summer seasons (altered amount of ice brought with chips and temperature of chips);
- Wood chip quality (size of chips, pin chips/ordinary chips);
- Moisture content of chips;
- Chip bulk density (hardwood VS softwood but also changes within each type).

Yet another specific objective is to be able to reduce the torque demand on mechanical feed means in bottom of the down flow vessel, typically a bottom scraper. When the chip quality occasionally is outside of specifications, for example a high content of fine wood particles (sawdust or pin chips fractions are high), then the compaction of the chip column in the vessel might increase to such extent that the working load on the bottom scraper becomes excessively high. This may cause operational disturbances and production losses. To counter-act too high chip column compaction it is common practice to reduce the difference between the chip and liquor level in the vessel by increasing the liquor level so that the downward thrust from the chips being located above the liquid level is reduced. It is important that during such control should not the point of introduction of steam and/or hot liquor be drenched by the rising liquid level, which would reduce an effective generation of steam.

The invention can advantageously be used when cooking hard wood or softwood chips, bagasse, bamboo or other annual plants.

The characteristics of the invention are defined by the independent claims, and optional embodiments are defined in dependent claims in order of dependency of preceding claims. The invention is also disclosed in a preferred embodiment, but any specific feature of this embodiment could as such be included in the invention optionally, if not specifically defined as a necessary feature for the argued effect.

DETAILED DESCRIPTION OF PREFERRED EMBODIMENTS

During following description will the term "treatment liquid" be used, and by this is meant one kind of treatment liquid that is intended to be added evenly to the entire chip flow in the treatment vessel. This treatment liquid could comprise only of steam, but also hot spent cooking liquor, i.e. black liquor, from a subsequent digester, as well as a mixture of two or more of following hot liquids;

- black liquor,
- fresh cooking chemicals such as white liquor (and additives e.g. antraquinon),
- dilution liquids from subsequent wash stage (i.e. wash filtrate from such wash stages),
- steam (added directly in order to heat the treatment liquor).

The term "treatment vessel" will also be used, and by this is meant any kind of treatment vessel used for treating chips in either form of delignification or impregnation state, i.e. the vessel could be an atmospheric combined steaming and treatment vessel like IMPBIN, or a pressurized digester.

The term "comminuted cellulose material" will be used, which preferably could be in form of wood chips, but also more fragmented wood material such as sawdust or pin chips, all obtained from either hardwood or softwood or annual plants.

Figure 1:
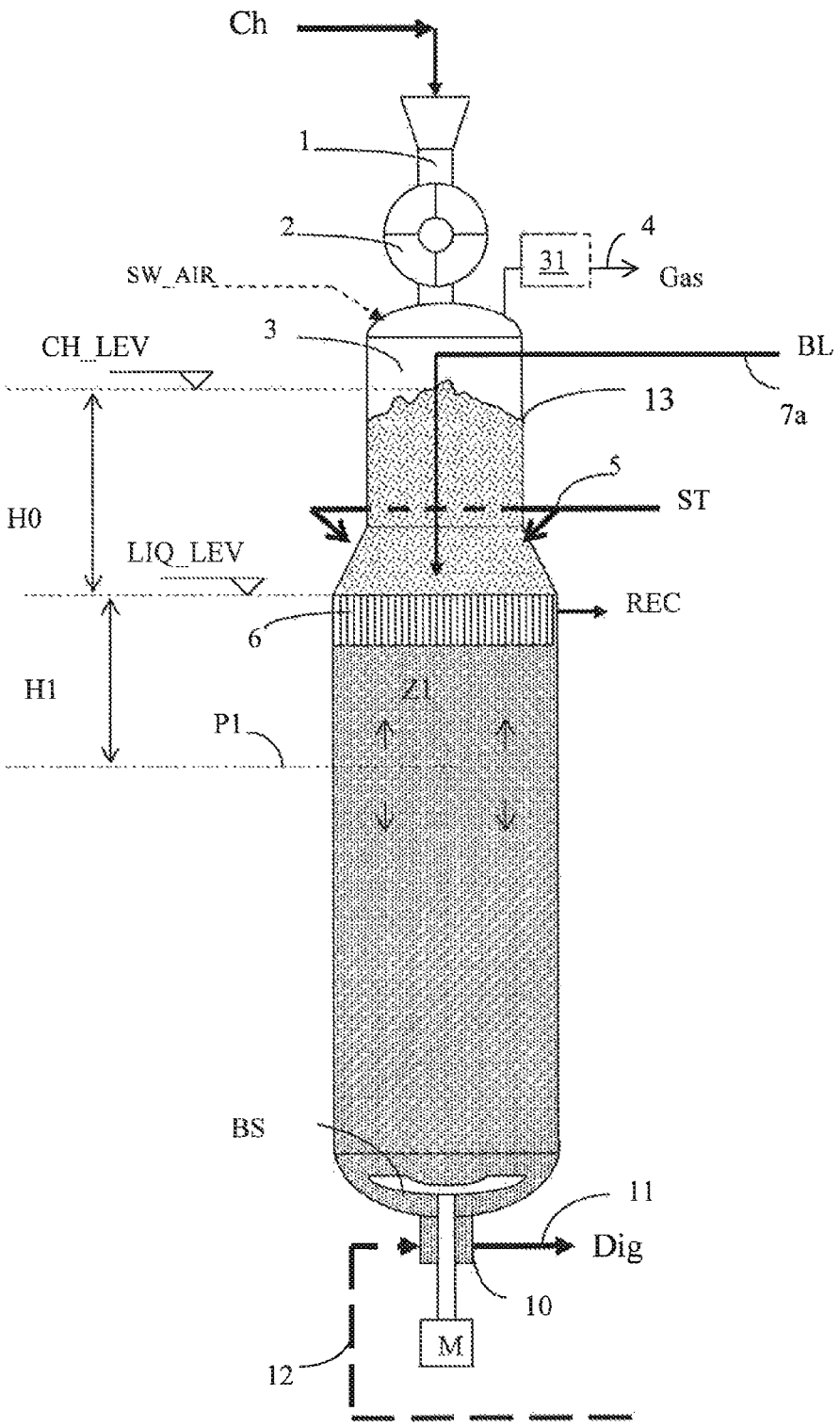
FIG. 1 shows an impregnation vessel according to state of the art.

A prior art arrangement for the impregnation of chips during the manufacture of chemical pulp is shown in FIG. 1, and is in all essential parts of the IMPBIN concept sold by Metso Paper, including the method of wet-steaming chips in a substantially atmospheric pressure (±0.5 bar(g), i.e. not a pressure vessel). The arrangement comprises an essentially cylindrical impregnation vessel 13 arranged vertically into which unsteamed chips are continuously fed into the top of the impregnation vessel via feed means, in the form of a small chip buffer 1 without steaming and a chute feed (chip feed) 2. The chips that are fed into the impregnation vessel are thus unheated chips that normally have the same temperature as the ambient temperature.

The pressure in the vessel can be adjusted as necessary through a control valve 31 arranged in a valve line 4 at the top of the impregnation vessel, possibly also in combination with control of the steam ST via input lines 5.

When atmospheric pressure is to be established, this valve line can open out directly to the atmosphere. It is preferable that a pressure is established at the level of atmospheric pressure, or a slight deficit pressure by the outlet 4 of magnitude −0.5 bar (g) (−50 kPa), or a slight excess pressure of magnitude up to 0. 5 bar (g) (50kPa).

Input of a ventilating flow, SW_AIR (sweep air), can be applied at the top as necessary, which ensures the removal of any gases present or brought into the vessel by the in feed of comminuted cellulosic material.

The impregnated chips are continuously fed out via output means, here in the form of an outlet 10, possibly also in combination with bottom scrapers (BS), at the bottom of the impregnation vessel 30.

The level of the chips, CH_LEV, above the level of the liquid, LIQ_LEV, should preferably be at least 2 meters and preferably at least 5 meters when impregnating wood chips. In the case of pulping raw material of low bulk density, a corresponding increase in the height of the column of chips over the surface of the fluid is preferably established. This height is important in order to provide an optimal passage of the chips in an even plug flow through the vessel.

When impregnating primarily easily cooked types of wood, such as eucalyptus and other annual plants, steaming with fresh steam can be essentially avoided, especially in a warm climate where chip temperature normally is high. Fresh steam is thus not necessarily added to the chips that lie above the fluid level established by the impregnation fluid during normal steady-state operation. The invention can also be applied also if softwood with lower bulk density is used as raw material.

When treating primarily wood raw material that is difficult to cook, especially softwood having less density, and in operational cases with extremely low temperature of the chips, such as during the cold season, the chips that lie above the fluid level established by the impregnation fluid can be heated by the addition to the impregnation vessel of external steam ST such that a temperature of the chips approach 100° C. in the chip pile before the chips reach the fluid level that has been established by the treatment liquor The hot treatment liquid added via a common central pipe 7*a* can also be established as a mixture from totally separate sources, that is, not from one common flow of black liquor.

For example, the treatment liquor may also contain a wash filtrate.

The treatment liquid added can also be a mixture of black liquor and an additive amount of fresh cooking chemicals, i.e. white liquor, as well as steam with the object of establishing alkali profiles that are necessary for the process. In particular if the residual alkali in the black liquor is low. A rapid initial consumption of alkali normally takes place, simply in order to neutralize the wood acidity, while it is desired to keep the final residual alkali after the impregnation stage at a certain level. The needed amount of additional alkali is mostly dependent on the level of wood acidity being released during steaming in the chip volume above the liquid level, and thus dependent on type of wood being treated (softwood or hardwood).

The vessel may be equipped without or with extraction screens 6 to allow liquid extraction (REC) early in the process.

Figure 2:
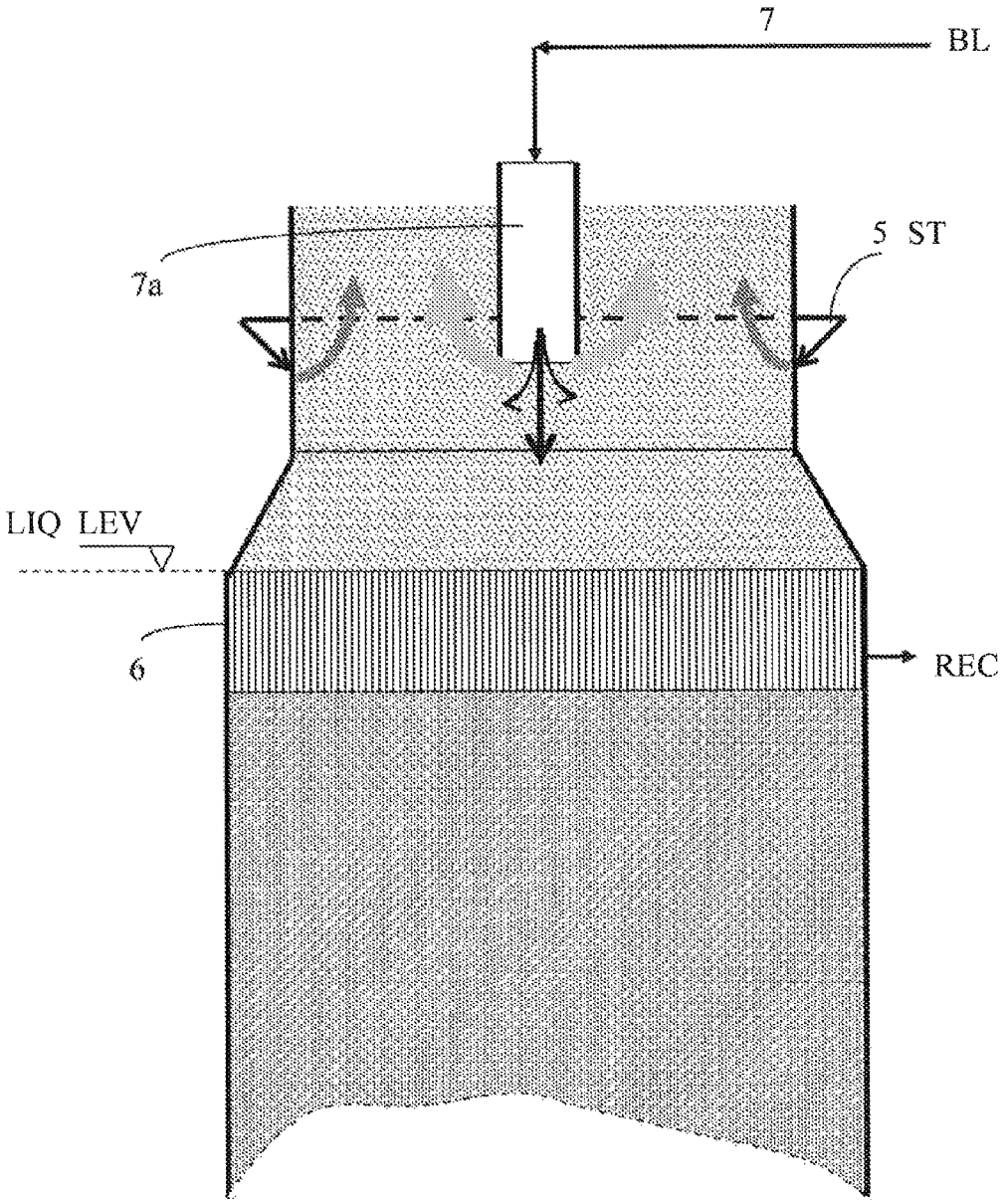
FIG. 2 shows a detail of a central pipe used in FIG. 1.

In FIG. 2 is a detail view of FIG. 1 of the area of addition of the treatment liquor BL via a single central pipe 7. As is disclosed here is the outlet from the central pipe 7 located above the liquid level, LIQ_LEV. The hot treatment liquor being added according to the wet-steaming concept is added to the center of the vessel as shown with downwardly directed arrows. The pressure in the chip pile at level of the outlet end of the central pipe is lower than the boiling pressure of the treatment liquor added, and the treatment liquor added will thus flash off steam as shown in grey colored upwardly directed arrows. Additional fresh and/or flash steam ST generated from another heat recovery system (such as flash cyclone, re-boiler, heat exchanger etc.) could also be added at this height position dependent on need for such additional steam, and this flow of steam is shown also in grey colored upwardly directed arrows.

Figure 3:
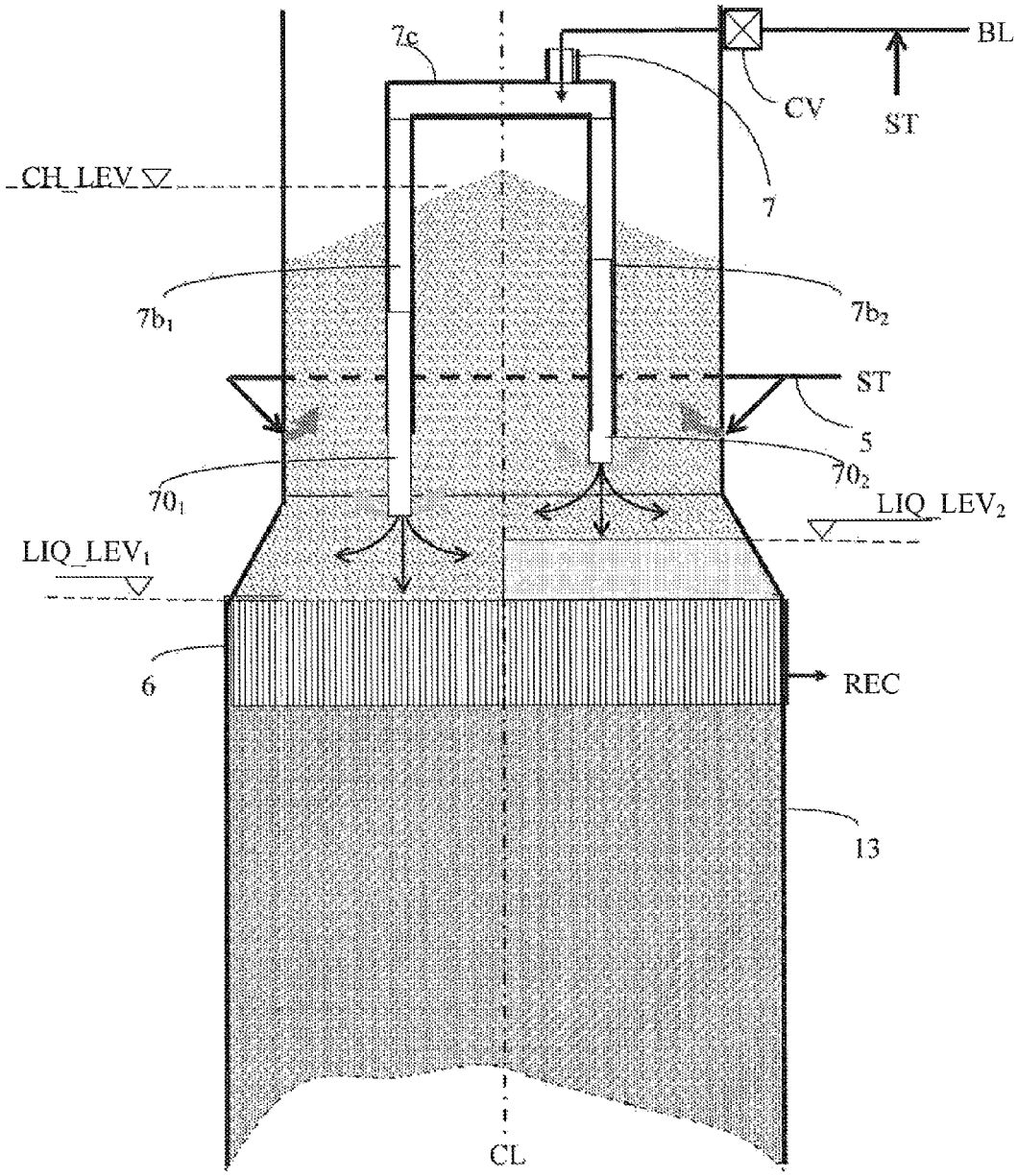
FIG. 3 shows an embodiment of the invention in a side view.

In FIG. 3 is a preferred embodiment of the invention shown, with emphasis on the improvements made in relation to the prior art design in FIG. 1. In the left hand side of the center line CL is shown establishment of a lower liquid level $LIQ_LEV_1$, while on the right hand side of the center line CL is shown establishment of a higher liquid level $LIQ_LEV_2$.

Here is shown an arrangement for adding the hot treatment liquor BL to comminuted cellulose material, preferably wood chips, during the manufacture of chemical pulp in a continuous process. Said process using a down flow vessel 13 where comminuted cellulose material is descending down the vessel in a plug flow and where treated comminuted cellulose material is continuously fed out at the bottom of the vessel, similar to what is intended in FIG. 1. As two different modes are shown at each side of the center line CL are 2 pipes $7b_1$ and $7b_2$ shown for addition of hot treatment liquor, but in some embodiment could of course only one pipe be used, or alternatively more than 2 pipes.

The treatment liquor BL is supplied from a common source BL via piping 7 to a common header 7*c*. More than 2 vertical pipes $7b_1$ and $7b_2$ are connected with their upper end to the common header 7*c*. The vertical pipes $7b_1$ and $7b_2$ preferably have an upper stationary pipe part and telescopically arranged with said stationary pipe part is a lower outlet part $70_1$ and $70_2$ respectively.

The lower outlet parts having their open lower ends inserted in the chip plug flow.

As shown in the left hand side of the center line CL is a lower liquid level $LIQ_LEV_1$ established, and the height position of lower outlet part $70_1$ is adjusted to a distance above this liquid level. As shown in the right hand side of the center line CL is a higher liquid level $LIQ_LEV_2$ established, and the height position of lower outlet part $70_2$ is adjusted to a distance above this liquid level. In each case the adjustment is made by sliding the lower outlet part telescopically on or in said stationary pipe part.

As shown in FIG. 3 could a single control valve CV be arranged in the piping 7 outside of the treatment vessel 13.

As shown in the FIG. 3 could also, but not necessarily, a withdrawal strainer 6 be arranged in the wall of the treatment vessel, withdrawing a flow of treatment liquid from the treatment vessel, said withdrawal strainer being located below the open lower ends of the vertical pipes 7*b*. The need for any such withdrawal strainer is, among others, dependent on the alkali profiling of the entire process and type of wood.

Figure 4:
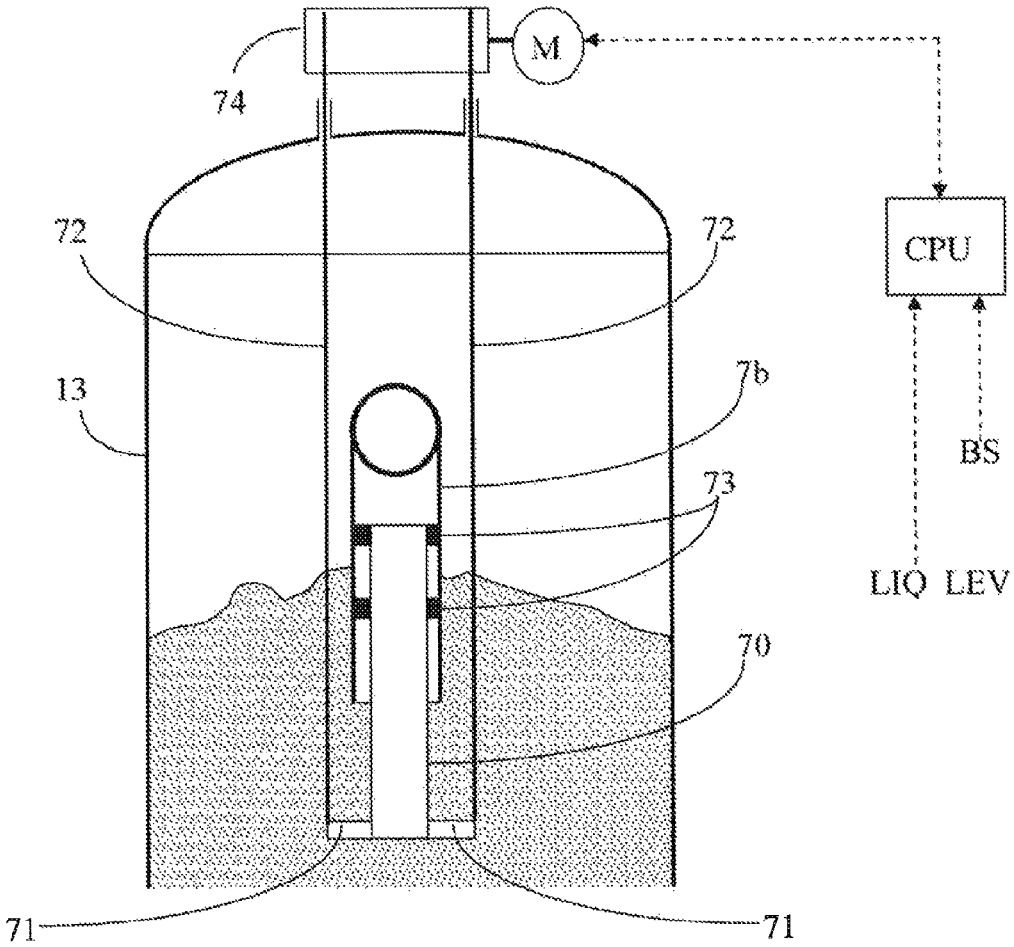
FIG. 4 shows a first principle design of the adjustable pipe.

FIG. 4 disclose one principle of adjusting the pipe in a telescopic manner. Here is the vertical stationary pipe part 7*b* equipped with a lower outlet part 70 arranged inside of the stationary pipe part. The height position of the lower outlet part 70 is controlled by adjustment means including wire connectors wound up on a drum 74 driven by a motor M and with the lower end of wire connectors attached at a pulling lug 71 at the lower outlet part 70. Preferably could sealing elements 73 be arranged between the pipes. By using wires could a positive pulling force be transmitted to the lower outlet part when lifting it to a higher position. When the lower outlet part is to be lowered is gravity forces used as well as the pressure inside the pipe, as there is an area reduction ahead of the lower outlet part onto which the pressure is acting.

A control system CPU could be used, having at least one process parameter as input parameter for controlling the height position of the lower outlet part 70, and the control unit could via a bi-directional connection control the motor and position obtained by the adjustment means. One such input parameter could be the detected liquid level LIQ_LEV, and another input parameter could be the detected torque requirement on the bottom scraper BS.

Control Modes

If the actual liquid level is used as a feed-back signal, the system could otherwise change net input flows of liquid and as soon as the liquid level starts to rise, the adjustment means starts lifting the lower outlet pipe striving to maintain a set distance between liquid level and outlet of the outlet part 70. to the vessel liquid level. If the intended liquid level is used as a feed-forward signal, the system could start lifting the lower outlet part 70 as soon as the intended control to increase the liquid level starts to act.

If the torque requirement on the bottom scraper BS exceed a set level could also the system start lifting the lower outlet part 70 with simultaneous increase of the liquid level.

Figure 5:
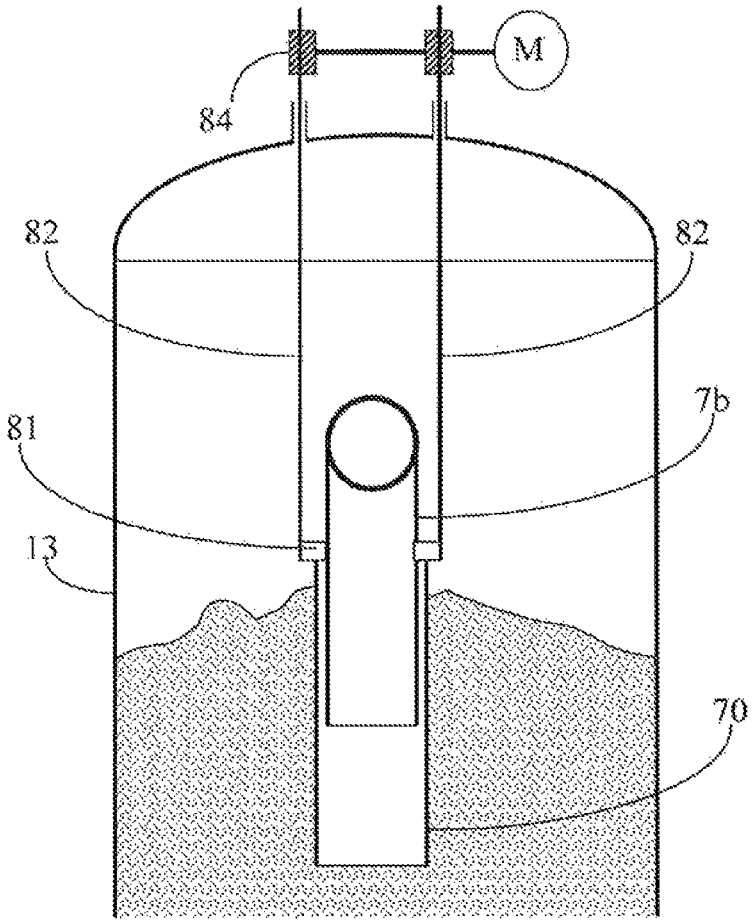
FIG. 5 shows an alternative principle design of the adjustable pipe.

FIG. 5 disclose another principle of adjusting the pipe in a telescopic manner. Here is the vertical stationary pipe part 7*b* equipped with a lower outlet part 70 arranged outside of the stationary pipe part. The height position of the lower outlet part 70 is controlled by adjustment means including sturdy pulling rods 82 driven by pulley wheels via a motor M and with the lower end of pulling rods attached at a pulling lug 81 at the lower outlet part 70. Preferably could the pulling lugs 81 include sealing elements. The sturdy pulling rods could pull the lower outlet part both in the upward as well as the downward direction.

The arrangement with a telescopic pipe thus provides a possibility to change the liquid level established in the vessel, while allowing addition of treatment liquid in form of steam, or preferably hot treatment liquor flashing off steam, to be made close to the liquid surface but still above the liquid level. The steaming effect will thus be able to steam the entire chip volume above the liquid level.

The possibility to alter the liquid level, while maintaining maximum steaming effect, is important in order to adapt the process to different process conditions.

Different process conditions could depend on the wood material fed to the vessel. For instance could the specific weight of chips change, due to changes in type of wood or wood mixture (softwood/hardwood), or if more juvenile wood is fed to vessel, or if the vessel is used in the winter or summer (amount of ice brought into vessel by chips may change steaming requirement).

Changing the liquid level is also an important control aspect when trying to reduce the torque requirements on any bottom scraper located in bottom of vessel. By lifting the liquid level could the downward force from the chip pile above the liquid level be reduced, and hence the total downward thrust from the chip plug onto the bottom scraper.

The invention could be altered in many ways under the inventive scope as defined in claims. The telescopic pipe could also be by other means than by using two tubes sliding concentrically on each other. For instance could the upper stationary pipe part be connected to the lower outlet part via some bellow mechanism. The lower outlet part could include at least 2 sliding tubes, i.e. also using an intermediate sliding tube between the upper stationary pipe part and the lowermost outlet part. In its simplest form could the adjustment mean simply include a hand cranked adjustment wheel.

While the present invention has been described in accordance with preferred compositions and embodiments, it is to be understood that certain substitutions and alterations may be made thereto without departing from the spirit and scope of the following claims.

The invention claimed is:

1. A method for adding a treatment liquid to comminuted cellulose material during a manufacture of chemical pulp in a continuous process using a down-flow vessel, comprising, descending chips down the vessel in a plug flow, continuously feeding out treated chips at the bottom of the vessel adding a treatment liquid via at least one telescopic pipe being arranged above a liquid level and parallel to a plug flow direction of the plug flow, the at least one telescopic pipe having a lower outlet part, a control system detecting a change of an input parameter, and the change of the input parameter triggering an adjustment of a height position of the lower outlet part inside the down-flow vessel.

2. The method according to claim 1 wherein an adjustable liquid level is established in the plug flow, an outlet of the telescopic pipe is correspondingly adjusted to have the outlet of the telescopic pipe disposed above the liquid level but below an upper surface level of a chip volume established above the liquid level.

3. The method according to claim 2 wherein a temperature of the treatment liquid, added via the telescopic pipe at a position of the outlet, is controlled such that the temperature exceeds the boiling temperature at a prevailing pressure close to the outlet and such that a flashing effect is obtained into the chip volume located above the liquid level in the vessel.

4. The method according to claim 3 wherein the treatment liquid is a hot treatment liquor having a temperature of the treatment liquor exceeding the boiling temperature at the prevailing pressure close to the outlet such that the flashing effect is obtained by releasing steam from the treatment liquor into the chip volume.

5. The method according to claim 3 wherein a height position of the outlet of the telescopic pipe is changed depending on process parameters of the cellulose material.

6. An arrangement for adding a treatment liquor to comminuted cellulose material during a manufacture of chemical pulp in a continuous process using a down-flow vessel wherein chips are descending down the vessel in a plug flow and wherein treated chips are continuously being fed out at a bottom of the vessel, comprising, at least one pipe, connected to a source (BL) containing the treatment liquid, is arranged inside the vessel and parallel to a plug flow direction of the plug flow, and the pipe having a lower outlet part being controllable by wires or rods connected to the lower outlet part for adjusting a height position of the lower outlet part inside the vessel wherein a control unit (CPU) which controls the pipe height is connected to a sensor which is adapted to detect a liquid level in the vessel.

7. The arrangement according to claim 6 wherein lower outlet part is telescopically arranged on a stationary pipe part.

8. The arrangement according to claim 7 wherein the wires or rods are connected to an external motor (M) arranged outside the vessel, the motor is connected with connecting members to the lower outlet part.

* * * * *